US005364505A

United States Patent [19]

Funk et al.

[11] Patent Number: 5,364,505

[45] Date of Patent: Nov. 15, 1994

[54] PRESSURIZED OZONE PULP DELIGNIFICATION REACTOR AND A COMPRESSOR FOR SUPPLYING OZONE TO THE REACTOR

[75] Inventors: Erwin D. Funk, Glens Falls, N.Y.; Kaj Henricson, Kotka, Finland; Stephen J. Dunn, Glens Falls, N.Y.

[73] Assignee: Kamyr, Inc., Glens Falls, N.Y.

[21] Appl. No.: 989,932

[22] Filed: Dec. 7, 1992

[51] Int. Cl.[5] ..... D21C 7/12; D21C 9/153

[52] U.S. Cl. ..... 162/238; 162/49; 162/62; 162/65; 162/263; 422/186.14

[58] Field of Search ..... 162/65 B, 198, 237, 162/238, 252, 263, 49, 62; 422/111, 186.12, 186.14

[56] References Cited

U.S. PATENT DOCUMENTS

| | | | |
|---|---|---|---|
| 3,549,528 | 12/1970 | Armstrong | 422/186.14 |
| 4,255,257 | 3/1981 | Greiner et al. | 210/709 |
| 4,279,694 | 7/1981 | Fritvold et al. | 162/65 B |
| 4,902,381 | 2/1990 | Meredith | 162/65 B |
| 4,978,508 | 12/1990 | Hansen et al. | 422/186.14 |
| 5,133,946 | 7/1992 | Schwarlz | 162/65 B |

FOREIGN PATENT DOCUMENTS

| | | | |
|---|---|---|---|
| 397308 | 11/1990 | European Pat. Off. . | |
| 426652 | 5/1991 | European Pat. Off. . | |
| 511433 | 11/1992 | European Pat. Off. | 162/65 B |
| 512977 | 11/1992 | European Pat. Off. . | |
| 55-67506 | 5/1990 | Japan | 422/186.14 |
| 5132884 | 5/1993 | Japan . | |

*Primary Examiner*—Steve Alvo

*Attorney, Agent, or Firm*—Nixon & Vanderhye

[57] ABSTRACT

A method and apparatus supply ozone containing gas under superatmospheric pressure to an ozone delignification device. The speed of a water ring compressor is controlled so that it compresses as much ozone gas per unit time at desired superatmospheric pressure as the ozone delignification unit utilizes, with essentially no excess. The ozone containing gas is fed from the water ring compressor through a separator buffer tank which levels out pressure pulses and separates cooling water from compressed ozone gas prior to the gas entering the ozone delignification unit. The gas passes through a control valve controlled by a mass flowmeter which senses the amount of cellulose pulp fed to the ozone delignification unit. The speed control of the compressor may be provided by a differential pressure controller connected across the control valve.

23 Claims, 1 Drawing Sheet

PRESSURIZED OZONE PULP DELIGNIFICATION REACTOR AND A COMPRESSOR FOR SUPPLYING OZONE TO THE REACTOR

BACKGROUND AND SUMMARY OF THE INVENTION

Ozone delignification of cellulose pulp is at last becoming a commercial reality. It has been found that it is highly desirable, if not essential, to compress the ozone containing gas so that it is at superatmospheric pressure (e.g. 5 to 20 atmospheres) before utilizing it in an ozone delignification device. However, care must be taken when compressing the ozone to keep its temperature at or below ambient temperature, otherwise there can be significant hazards and/or operational difficulties. This is preferably accomplished by utilizing a water ring compressor. The heated water from the water ring compressor (absorbing the heat compression of the ozone gas) is separated from the ozone containing gas, and externally cooled with a heat exchanger.

When supplying pressurized ozone containing gas to an ozone delignification unit, it is highly desirable to supply the ozone almost directly to the delignification unit utilizing only a small buffer tank, in order to minimize ozone decomposition. The small buffer tank performs the dual purposes of leveling out pressure pulses from the compressor and providing a place for the compressed gas and cooling water to separate. The vessel should only be as large as necessary to accomplish the separation of the gas and liquid, meaning that the compressor must operate continuously to supply the ozone delignification process. Conventionally, continuous operation of the compressor would be accommodated by operating the compressor with an unloader valve that recycles excess compressed ozone back to the compressor inlet. However, this recycling causes some decomposition of ozone, which is undesirable, making the conventional approach less than acceptable for commercial operations.

According to the present invention a method and apparatus are provided which allow the compressor to continuously operate but yet provide only the quantity of ozone that is needed by the ozone delignification unit. Basically, this is accomplished according to the invention by controlling the speed of operation of the compressor so that it compresses as much ozone per unit time at desired superatmospheric pressure as the ozone delignification process utilizes, with essentially no excess.

According to one aspect of the present invention a method of supplying ozone containing gas under superatmospheric pressure to effect ozone delignification of cellulose pulp, utilizing a compressor, is provided. The method comprises the steps of: (a) Controlling the speed of operation of the compressor so that it compresses as much ozone per unit time at desired superatmospheric pressure as the ozone delignification process utilizes, with essentially no excess. And, (b) feeding the ozone in carrier gas from the compressor essentially directly to the ozone delignification process. The compressor is preferably a water ring compressor, and step (a) is practiced to ensure a minimum speed of operation of the water ring compressor generally corresponding to the minimum speed necessary to form a ring of water in the compressor. Step (b) is preferably practiced by the substeps (b1) and (b2) of leveling out the pressure pulses from the compressor, and separating cooling water from the water ring compressor and compressed ozone gas prior to feeding the ozone gas to the ozone delignification process.

The invention also comprises the step of determining if the pressure output from the compressor exceeds a predetermined desired maximum, and in response to such sensing recycling the ozone gas to the compressor. Typically a control valve is disposed between the compressor and the ozone delignification process and there is the further step (c) of controlling the amount of ozone passing through the control valve in response to mass flow sensing of the amount of cellulose pulp being fed to the ozone delignification process. Step (a) is desirably practiced utilizing a differential pressure controller connected across the control valve to control the speed of the compressor, and to minimize the pressure drop across the control valve. Step (a) also includes a substep (a1) in which the mass of the ozone fed to the device is determined by combining the flow volume with an ozone concentration sensor reading.

The invention also comprises an apparatus for effecting ozone delignification of cellulose pulp. The apparatus comprises: A source of ozone gas in carrier gas. A utilization device for combining ozone in carrier gas, under superatmospheric pressure, with cellulose pulp to effect delignification of the pulp with ozone. A water ring compressor connected between the source and utilization device, for compressing the ozone in carrier gas and supplying the compressed ozone to the device. And, speed control means for controlling the speed of the water ring compressor so that it compresses as much ozone per unit time at desired superatmospheric pressure as the utilization device utilizes, with essentially no excess.

The apparatus also preferably comprises a separator buffer tank disposed between the compressor utilization device for leveling out pressure pulses from the compressor and separating water from compressed gas. The tank has a minimum volume for performing the leveling out and separating functions so as to minimize ozone decomposition. A control valve is disposed between the separator buffer tank and the utilization device, and a mass flowmeter senses the mass flow of cellulose pulp to the utilization device and means are provided for controlling the amount of gas passing through the control valve in response to the mass flow sensing.

The speed control means preferably comprises a differential pressure controller operatively connected across the control valve, for measuring the difference in pressure between the compressor discharge and the ozone utilization device, and operatively connected to the water ring compressor. A gas line also extends from between the separator buffer tank and the control valve back to between the ozone gas source and the water ring compressor, and a back pressure regulator means is disposed in the gas line for ensuring that the pressure does not exceed a level which could damage system components.

A heat exchanger and water recirculating line are also operatively associated with the separator buffer tank and the compressor, the water recirculating line extending from a bottom portion of the separator buffer tank to the heat exchanger and to a point between the ozone source and the water ring compressor. Also means are provided for circulating cooling fluid into the heat exchanger to cool the water passing therethrough.

A check valve is disposed between the control valve and the utilization device to prevent the flow of fluid from the utilization device to the compressor, and a check valve is provided between the ozone source and the water ring compressor to prevent fluid passing from the compressor to the ozone source.

It is the primary object of the present invention to provide a method and apparatus for ensuring that the quantity of ozone that is needed by an ozone consuming process is continuously produced and used without substantial decomposition. This and other objects of the invention will become clear from an inspection of the detailed description of the invention and from the appended claims.

DETAILED DESCRIPTION OF THE DRAWING

Figure 1:
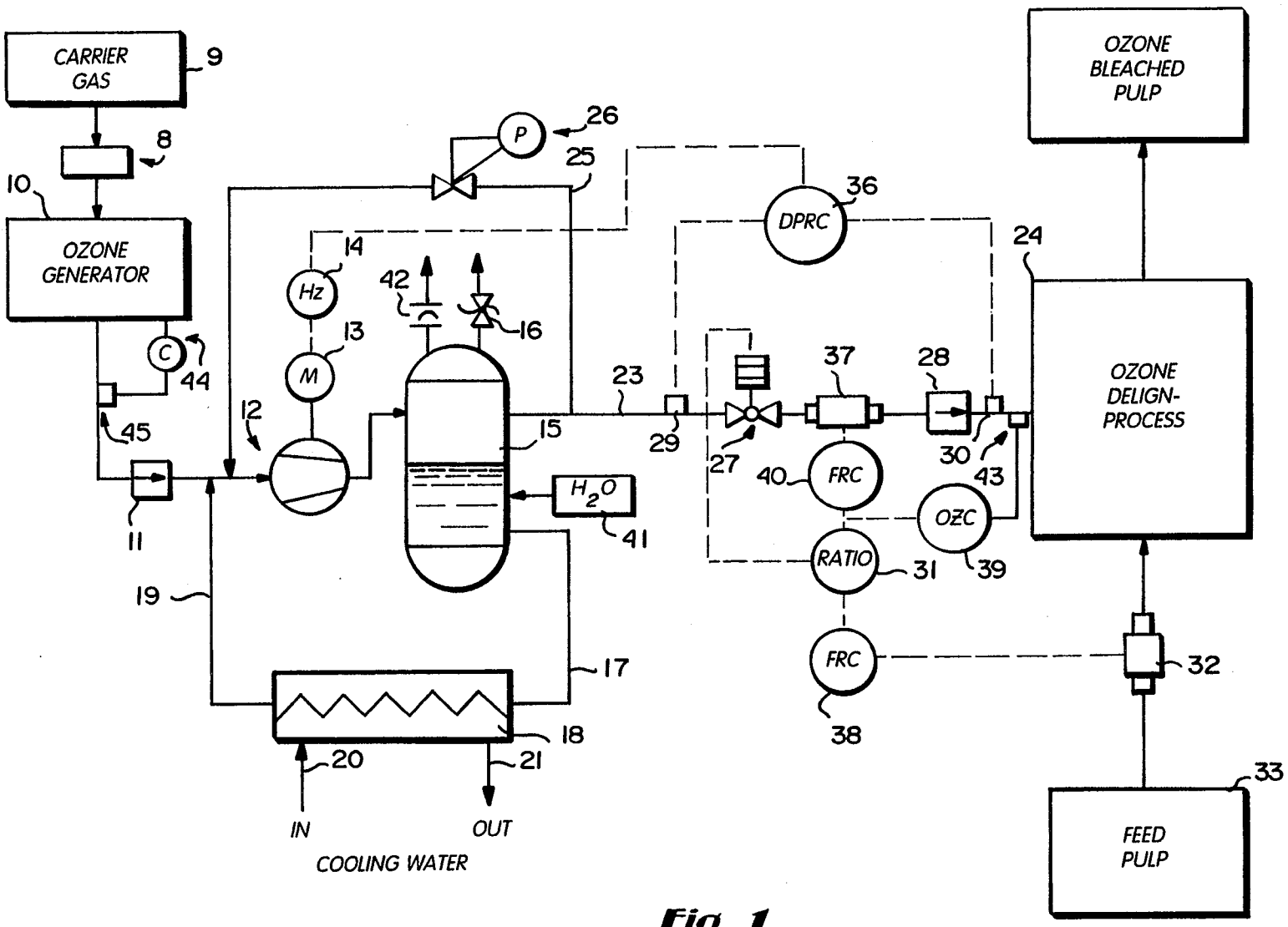
FIG. 1 is a schematic view of exemplary apparatus according to the present invention.

FIG. 1 schematically illustrates exemplary apparatus according to the present invention. The apparatus includes a source of carrier gas, 9; an ozone generator, 10, which supplies ozone in the carrier gas and a pressure regulator, 8. The regulator, 8, maintains a specified pressure within the generator, 10, so that sufficient carrier gas is available when flow demands vary. The amount of ozone in the carrier gas typically is about 10% if the carrier gas is oxygen, but any practical desired amount can be provided. The power input to the ozone generator is controlled by means of ozone concentration controller, 44. This controller is operatively connected to an ozone concentration sensor, 45. As the concentration of ozone varies with the required gas flow, the power input to the generator is varied to maintain a specified concentration. The ozone generator 10 is connected through a check valve 11 to a compressor 12, preferably a water ring compressor. The water ring compressor 12 has a motor 13 which operates it, controlled by a motor controller 14. The compressor raises the pressure of the ozone gas to any desired level, typically 2–20 bar (e.g. about 5–15 bar).

The outlet from the water ring compressor 12 is connected to a separator buffer tank 15. The separator buffer tank 15 comprises means for leveling out pressure pulses from the compressor 12, and provides a place where the compressed ozone-containing gas and cooling water separate. The tank 15 preferably has a minimum volume, the volume being only great enough to perform the intended functions described above. Pressure relief can be provided from the tank 15 as indicated at 16. From a bottom portion of the tank 15 a water recirculating line 17 is provided which is connected to a heat exchanger 18, and then returned—as illustrated at 19—to a point between the check valve 11 and the compressor 12. Cooling water is fed into and removed from the heat exchanger 18, as indicated at 20, 21 in FIG. 1. This allows the same water to be recirculated for the water ring compressor 12, and ensures that the temperature of the compressed ozone containing gas is kept substantially at or below ambient temperature. Make-up water is added as needed at 41 to maintain a constant water level in tank 15.

The line 23 extending downstream from the tank 15 ultimately leads to an ozone delignification device reactor 24, which may be any suitable delignification or bleaching device, such as shown in published European patent application 0397308 filed Mar. 20, 1990. The device 24 can treat pulp at high, low or medium consistency. In order to ensure safety of the system, a back pressure regulator 26 preferably is provided in a recirculating line 25 between the line 23 and the inlet to the compressor 12. The back pressure regulator 26 ensures that the output pressure from the compressor 12 never exceeds the system design pressure. The back pressure regulator 26 will open at a set, predetermined, value and maintain that value by unloading compressed ozone to the compressor inlet. A relief valve 16 and rupture disk 42 also may be provided to back tip the back pressure regulator 26.

In the line 23 are a control valve 27, a flowmeter 37, pressure ports 29, 30 on opposite sides of the control valve 27, a check valve 28, and an ozone concentration sensor 43. The control valve 27 is controlled by the controller 31 operatively connected to a mass flowmeter 32. The mass flowmeter 32 senses the amount of cellulose pulp (which may be either at low consistency, medium consistency, or high consistency) from a digester or other source 33 to the utilization unit reactor 24. The more the mass of the pulp being fed through the mass flowmeter 32, the more the control valve 27 is opened to allow more ozone containing gas to the utilization device 24. The control valve, 27, is modulated to provide a fixed ratio of ozone to pulp on a mass basis. The mass rate of ozone is established by multiplying the ozone concentration of ozone monitor 39 by the total flow, 40.

Speed control for the motor 13 is provided utilizing a differential pressure controller 36 which is connected to the ports 29, 30 on opposite sides of the control valve 27. Port 30 is located downstream of check valve 28. The differential pressure controller 36 measures the pressure between the compressor 12 discharge and the ozone utilization device 24. This differential pressure is used to control the motor, 13, through the controller, 14, to thereby provide ozone gas at a fixed differential pressure above the pressure in the utilization device 24. This differential, usually between 5–10 psig, ensures that the pressure drop across the valve 27 is within a range such that the valve 27 operates within a controllable range. This also allows the compressor 12 to operate at a minimum pressure.

The controller 14 and/or motor 13 are specifically designed so that the water ring compressor 12 always operates above the minimum speed at which the ring of water forms by centrifugal force in the compressor 12.

Utilizing the apparatus illustrated in FIG. 1 ozone delignified (bleached) pulp is produced utilizing superatmospheric pressure ozone in carrier gas. The ozone gas is supplied safely, at ambient temperature or below, with a minimum pressure drop across the control valve 27, so as to minimize losses. Thus using conventional and readily available equipment the right amount of ozone in carrier gas is always supplied to the delignification unit 24.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent apparatus and methods.

What is claimed is:

1. Apparatus for effecting ozone delignification of cellulose pulp, comprising:

a source of ozone gas in carrier gas;

a reactor for combining ozone in carrier gas, under superatmospheric pressure, with cellulose pulp to effect delignification of the pump with ozone;

a water ring compressor connected between said source and said reactor, for compressing the ozone and carrier gas and supplying the compressed ozone containing gas to said reactor;

means for sensing the pressure between the compressor and the reactor; and speed control means for controlling the speed of said water ring compressor in response to said sensing means so that said compressor compresses as much ozone per unit time at desired superatmospheric pressure as said reaction utilizes, which essentially no excess, and so that said superatmospheric pressure is maintained above the pressure in the reactor.

2. Apparatus as recited in claim 1 further comprising a separator buffer tank disposed between said compressor and reactor, for leveling out pressure pulses from said compressor and separating water from compressed gas, said tank having a minimum volume for performing said leveling out and separating functions so as to minimize ozone decomposition.

3. Apparatus as recited in claim 2 further comprising a control valve disposed between said separator buffer tank and said reactor.

4. Apparatus as recited in claim 3 wherein said speed control means comprises a mass flowmeter for sensing the mass flow of cellulose pulp to said reactor, and means for controlling the amount of gas passing through said control valve in response to said mass flow sensing.

5. Apparatus as recited in claim 4 wherein said speed control means further comprises a differential pressure controller operatively connected across said control valve, for measuring the pressure across said control valve, and operatively connected to said water ring compressor.

6. Apparatus as recited in claim 5 wherein said speed control means further comprises means for maintaining a minimum speed of said compressor above the speed required to insure that a ring of water forms in said compressor at all times.

7. Apparatus as recited in claim 6, further comprising a gas line extending from between said separator buffer tank and said control valve back to between said ozone gas source and said water ring compressor, and a back pressure regulator means disposed in said gas line for insuring that the compressor output pressure does not exceed a level which could damage said reactor, control valve, or other apparatus components.

8. Apparatus as recited in claim 5 further comprising a heat exchanger, and a water recirculating line, said water recirculating line extending from a bottom portion of said separator buffer tank to said heat exchanger, and to a point between said ozone source and said water ring compressor; and means for circulating cooling fluid into said heat exchanger to cool the water passing therethrough.

9. Apparatus as recited in claim 5 further comprising a check valve disposed between said control valve and said reactor to prevent the flow of fluid from said reactor to said compressor.

10. Apparatus as recited in claim 9 further comprising a check valve between said ozone source and said water ring compressor to prevent fluid from passing from said compressor to said ozone source.

11. Apparatus as recited in claim 4 wherein said speed control means permits said control valve to operate in a controllable range.

12. Apparatus as recited in claim 4 wherein said source of ozone comprises an ozone generator, and wherein said speed control means permits said ozone generator to operate at an optimum pressure.

13. Apparatus as recited in claim 4 further comprising an ozone concentration sensor for monitoring the amount of ozone passing to said reactor so that this concentration may be combined with the volume flow to determine the amount of ozone charged.

14. Apparatus for effecting ozone delignification of cellulose pulp, comprising:

a source of ozone gas in carrier gas;

a reactor for combining ozone in carrier gas, under superatmospheric pressure, with cellulose pulp to effect delignification of the pump with ozone;

a compressor connected between said source and said reactor, for compressing the ozone and carrier gas and supplying the compressed ozone containing gas to said reactor;

means for sensing the pressure between the compressor and the reactor;

speed control means for controlling the speed of said water ring compressor in response to said sensing means so that said compressor compresses as much ozone per unit time at desired superatmospheric pressure as said reactor utilizes, with essentially no excess, and so that said superatmospheric pressure is maintained above the pressure in the reactor; and a separator buffer tank disposed between said compressor and reactor, for leveling out pressure pulses from said compressor and separating water from compressed gas, said tank having a minimum volume for performing said leveling out and separating functions so as to minimize ozone decomposition.

15. Apparatus as recited in claim 19 wherein said source of ozone gas and carrier gas comprises an ozone generator; and wherein said speed control means permits said control valve to operate in a controllable range, and wherein said speed control means permits said ozone generator to operate at an optimum pressure.

16. Apparatus as recited in claim 14 further comprising a gas line extending from between said separator buffer tank and said control valve back to between said ozone gas source and said compressor, and a back pressure regulator means disposed in said gas line for insuring that the compressor output pressure does not exceed a level which could damage said reactor, control valve, or other apparatus components.

17. Apparatus as recited in claim 14 further comprising a check valve disposed between said control valve and said reactor to prevent the flow of fluid from said reactor to said compressor.

18. Apparatus as recited in claim 14 further comprising a check valve between said ozone source and said compressor to prevent fluid from passing from said compressor to said ozone source.

19. Apparats as recited in claim 14 further comprising an ozone concentration sensor for monitoring the amount of ozone passing to said reactor so that this concentration may be combined with the volume flow to determine the amount of ozone charged.

20. Apparatus for effecting ozone delignification of cellulose pulp, comprising: p1 a source of ozone gas in carrier gas;

a reactor for combining ozone in carrier gas, under superatmospheric pressure, with cellulose pulp to effect delignification of the pump with ozone;

a compressor connected between said source and said reactor, for compressing the ozone and carrier gas and supplying the compressed ozone containing gas to said reactor;

means for sensing the pressure between the compressor and the reactor;

speed control means for controlling the speed of said water ring compressor in response to said sensing means so that said compressor compresses as much ozone per unit time at desired superatmospheric pressure as said reactor utilizes, with essentially no excess, and so that said superatmospheric pressure is maintained above the pressure in the reactor;

a control valve for controlling the amount of gas passing from said compressor to said reactor; and a mass flowmeter for sensing the mass flow of cellulose pulp to said reactor, and means for controlling said control valve in response to said mass flow sensing.

21. Apparatus as recited in claim 20 wherein said speed control means further comprises a differential pressure controller operatively connected across said control valve, for measuring the pressure across said control valve, and operatively connected to said compressor.

22. Apparatus as recited in claim 21 further comprising an zone concentration sensor for monitoring the amount of ozone passing to said reactor so that this concentration may be combined with the volume flow to determine the amount of ozone charged.

23. Apparatus for effecting ozone delignification of cellulose pulp, comprising:

a source of ozone gas in carrier gas;

a reactor for combining ozone in carrier gas, under superatmospheric pressure, with cellulose pulp to effect delignification of the pulp with ozone;

a compressor connected between said source and said reactor, for compressing the ozone and carrier gas and supplying the compressed ozone containing gas to said reactor;

means for sensing the pressure between the compressor and the reactor;

speed control means for controlling the speed of said water ring compressor in response to said sensing means so that said compressor compresses as much ozone per unit time at desired superatmospheric pressure as said reactor utilizes, with essentially no excess, and so that said superatmospheric pressure is maintained above the pressure in the reactor;

a control valve for controlling the amount of gas passing from said compressor to said reactor;

a mass flowmeter for sensing the mass flow of cellulose pulp to said reactor, and means for controlling said control valve in response to said mass flow sensing; and wherein said speed control means comprises a differential pressure controller operatively connected across said control valve, for measuring the pressure across the control valve, and operatively connected to said compressor.

* * * * *